US005496203A

United States Patent [19]

Murray

[11] Patent Number: 5,496,203

[45] Date of Patent: Mar. 5, 1996

[54] BALLOON VALVE ASSEMBLY

[76] Inventor: Robert H. Murray, 52 Manor Hill Dr., Fairport, N.Y. 14450

[21] Appl. No.: 218,270

[22] Filed: Mar. 25, 1994

[51] Int. Cl.[6] ..... A63H 3/06

[52] U.S. Cl. ..... 446/222; 446/221; 446/224

[58] Field of Search ..... 446/220, 222, 446/224, 176; 137/855

[56] References Cited

U.S. PATENT DOCUMENTS

| | | | |
|---|---|---|---|
| 898,105 | 9/1908 | Herbst | 446/220 |
| 1,262,676 | 4/1918 | Kiriyama | 446/224 |
| 1,315,955 | 9/1919 | Gill | 446/224 |
| 1,370,178 | 3/1921 | Albert | 446/220 |
| 2,161,274 | 6/1939 | Behrend | 446/224 |
| 2,423,890 | 7/1947 | Hurt | 446/226 |
| 2,592,347 | 4/1952 | Shute | 446/220 |
| 2,701,672 | 2/1955 | Glasco | 446/226 |
| 2,792,669 | 5/1957 | Jackson et al. | 446/224 |
| 2,864,394 | 12/1958 | Hempel | 137/855 |
| 2,867,213 | 1/1959 | Thomas, Jr. | 137/855 |
| 2,924,041 | 2/1960 | Jackson et al. | 446/224 |
| 3,401,714 | 9/1968 | Scott | 446/222 |
| 4,701,148 | 10/1987 | Cotey | 446/224 |
| 4,890,637 | 1/1990 | Lamparter | 137/246 |
| 4,911,674 | 3/1990 | Cole | 446/224 |
| 5,167,561 | 12/1992 | Rizzo | 446/224 |

*Primary Examiner*—Mickey Yu
*Assistant Examiner*—Jeffrey D. Carrson
*Attorney, Agent, or Firm*—Howard J. Greenwald

[57] ABSTRACT

A balloon valve assembly for use in inflating balloons which contains a tube portion with a passageway, and a head portion adapted for insertion into the neck of an inflatable balloon which has a bottom wall forming a flange, an orifice through the bottom wall, and a side wall extending from the bottom wall and defining a substantially non-circular outer surface of the head portion. A valve flap member is mounted to the bottom wall of the head portion for sealing the orifice in the bottom wall.

23 Claims, 5 Drawing Sheets

BALLOON VALVE ASSEMBLY

FIELD OF THE INVENTION

This invention relates to a one-way check valve and more particularly to a valve for filling and inflating a toy balloon and then automatically sealing the balloon after such filling.

BACKGROUND OF THE INVENTION

Inflatable balloon assemblies are known to those skilled in the art. Thus, U.S. Pat. Nos. 2,924,041 of Jackson et al. and 3,616,569 of Litt et al. disclose such devices. According to U.S. Pat. No. 4,701,148 of Cotey, the devices of the Jackson et al. and the Litt et al. patents " . . . under some filling conditions . . . tend to squeal which is objectionable" (see column 1). In column 3 Cotey further states " . . . the normal range of pressures that balloons are normally filled . . . is 16 to 60 lb/in$^2$." It is difficult for a normal person to produce a pressure exceeding about 0.5 pounds per square inch using normal lung pressure.

The valve of the Cotey patent comprises an elongated generally tubular body member having an upper section and a lower section divided by a transverse interior wall, a radially outwardly directed frusto-conical flange diverging downward toward the lower edge of the lower section forming a seal with the bead at the mouth of the balloon, means defining at least one port communication with the lower section, and at least one opening in the side wall of the upper section. A valve produced in accordance with the Cotey patent is sold under the name of "QUALATEX" by the Pioneer Balloon Company of Wichita, Kans. However, notwithstanding the claims of the Cotey patent, this "QUALATEX" valve when used to fill a balloon with helium gas emits an annoying squeal which bears an amazing resemblance to a stuck pig. Furthermore, the "QUALATEX" valve cannot be used to inflate a balloon by mouth, is relatively heavy, weighing about 2.2 grams, and it is difficult to manually install a balloon onto this valve.

Another example of a prior art balloon valve is illustrated in U.S. Pat. No. 4,167,204 of Zeyra. The valve of this patent requires the insertion of a filler element to open and permit the flow of gas into the balloon. A valve made in accordance with the Zeyra patent is commercially available under the name of "E-Z SAFETY SEAL," and it is available from Creative Balloons, Inc. of Carmel Valley Village, Calif. These valves, however, cannot be inflated by mouth. Furthermore, a string is attached to an extended portion 9P of the Zeyra valve assembly by means of a metal staple 14 which, in addition to adding weight to the valve, presents a potential safety hazard to users since the crimped staple legs are exposed.

Yet another example of a prior or art balloon valve is presented in U.S. Pat. 4,292,999 of Szollmann. In column 1 of this patent, Szollmann notes that "It is known to tie off or simply knot the filling end of a balloon after the latter has been filled with air or gas. However, in such case it is possible only with difficulties to additionally replenish the air of a flaccid balloon or even to depressurize the balloon after use and refill . . . " Although the device of the Szollmann patent purports to solve these problems, it still requires a substantial amount of effort to fill a balloon with such device and thus cannot be readily used to fill a balloon by mouth. Furthermore, such device provides a relatively poor seal after the filling of the balloon. Thus, the device must be comprised of a cap 10 in order to effect " . . . portion 10 tightly sealing the upper end of tube 8" (see lines 61–62 of column 2).

In 1986, in Buchanan's U.S. Pat. No. 4,586,910, yet another device was described which attempted to overcome the disadvantages of the prior art balloon valves. At column 1 of this patent, the patentee disclosed that "A recurring problem with metalized and rubber toy balloons is one of providing such balloons with an inflatable valve adapted to expeditiously fill the balloon with an inert gas and to provide an efficient static seal . . . Conventional balloons are also prone to dislodgement after the balloon has been filled and the valve closed. The primary reason underlying the latter problem is that the conventional valve stem is normally pushed inwardly towards the outlet of the valve and the filling chamber of the balloon for closing purposes."

However, the device of the Buchanan patent suffers from its own unique disadvantages. In the first place, it is relatively complicated, requiring the presence of two slidably disposed molded parts. In the second place, the device of this patent must be mechanically or manually closed after a balloon is filled with fluid.

A valve made in accordance with the Buchanan patent is sold by M&D Balloons company of Brisbane, Calif. It is difficult to manually mount a balloon on such valve, and it is virtually impossible for an average person to fill a balloon with such valve by mouth.

Each of the devices of the aforementioned patents is comprised of a circular valve head. It is difficult to install the neck portion of a balloon over such a circular valve head.

To the best of applicant's knowledge, information, and belief, there is no balloon assembly, or balloon valve, provided by the prior art which enables a user to readily fill a balloon by mouth, which does not squeal during the filling process, which automatically provides a good static seal during and after such filling, which can readily be refilled, which is safe to use, and which is relatively simple in construction, lightweight and inexpensive to produce.

It is an object of this invention to provide a balloon valve which can be used to easily and readily fill a balloon without causing squealing during the filling process.

It is another object of this invention to provide a balloon valve which is relatively lightweight and readily enables the mounting of a balloon onto it.

It is another object of this invention to provide a balloon assembly which, after being filled with fluid, will automatically seal after the inflation pressure has been removed and will provide a good static seal, even when such balloon assembly is filled with helium.

It is yet another object of this invention to provide a balloon valve assembly which can be used comfortably when filling a balloon by mouth as well as by various gas filling nozzles in common use.

It is another object of this invention to provide a balloon assembly which, after having been filled and sealed, can readily be either refilled after partial deflation and/or rapidly deflated manually.

It is another object of this invention to provide a balloon assembly which is relatively inexpensive, and easy to use.

It is another object of this invention to provide a balloon assembly comprised of a balloon pump, a balloon valve, and a balloon.

It is another object of this invention to provide a balloon inflation assembly comprised of an inelastic flexible bag, two balloon valves, and a balloon.

It is yet another object of this invention to provide a balloon assembly comprised of a balloon valve, a balloon, and a means for tethering such balloon.

SUMMARY OF THE INVENTION

In accordance with this invention, there is provided a balloon valve assembly which is comprised of a valve device. The valve device contains a substantially non-circular head portion integrally formed with a stem portion and a mounting post adapted to receive a flap valve.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

The preferred balloon valve assembly of this invention will sealably mate with the neck portion of a toy balloon and sealably mate with a variety of gas dispensing nozzles. In addition, the valve assembly of such device permits filling the balloon by mouth as well as by a variety of gas dispensing nozzles.

Figure 1:
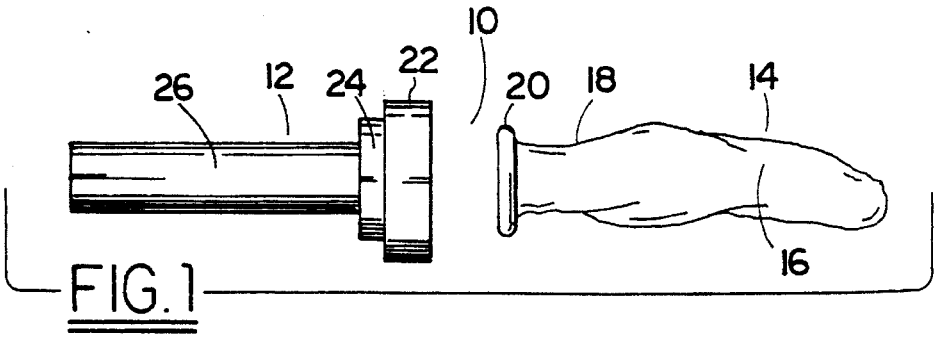
FIG. 1 is a side view of one preferred inflatable balloon assembly of this invention, with an unmounted balloon.

FIG. 1 illustrates a preferred embodiment of the balloon valve assembly 10 of this invention. Referring to FIG. 1, it will be seen that balloon valve assembly 10 is comprised of balloon valve 11 which, in turn, is comprised of valve head portion 12, a tube portion 26 (also referred to as stem portion 26), and balloon 14.

As is known to those skilled in the art, a balloon is a flexible bag which may be inflatable, which is often (but not necessarily) elastic, and which is generally (but not necessarily) spherical. Referring to FIG. 1, it will be seen that balloon 14 preferably is comprised of body portion 16 integrally formed with a neck portion 18 and a bead 20.

Applicant's balloon valve 11 (also referred to as valve body 11) may be used with most of the commercially available balloons and is especially useful with toy balloons. Thus, by way of illustration, the balloons manufactured by the Tilly Balloon Company of Fall River, Mass. may be used with such valve.

In one preferred embodiment, balloon 14 consists essentially of latex. As is known to those skilled in the art, the term latex refers to both natural latex and to synthetic latex.

Natural latex is a white, tacky, aqueous dispersion of a hydrocarbon polymer occurring naturally in some species of trees, shrubs, and plants; at least about 90 weight percent of the particles in natural latex are from about 0.5 to about 3.0 microns in maximum dimension. One important source of natural latex is the tropical tree *Hevea braizliensis,* Another source of latex is guayule, a shrub grown in Mexico and the southwestern United States, and several types of dandelions and related species. See, e.g., page 684 of N. Irving Sax et al.'s "Hawley's Condensed Chemical Dictionary," Eleventh Edition (Van Nostrand Reinhold Company, New York 1987).

Synthetic latex is generally made by emulsion polymerization techniques from styrene-butadiedne copolymer, acrylate resins, polyvinyl acetate, and the like; and it generally has a particle size ranging from about 0.05 to about 0.15 microns.

Any of the natural or synthetic latex balloons known to those skilled in the art may be used in the device of this invention. Thus, by way of illustration and not limitation, one may use the latex balloons disclosed in U.S. Pat. Nos. 5,039,461, 5,035,104, 4,884,990, and 4,879,928, the disclosure of each of which is hereby incorporated by reference into this specification.

Referring again to FIG. 1, it will be seen that valve body 11 (balloon valve 11) is comprised of side wall 22 (also referred to as flange 22), a second side wall 24 (also referred to as skirt 24), and stem 26.

In one preferred embodiment, valve body 11 consists essentially of a plastic material, and, preferably, consists essentially of a thermoplastic material. Any of the materials commonly used for injection molding may comprise valve body 11. Thus, e.g., one may use polypropylene, polyethylene, vinyl acetate, nylon, and the like. See, e.g., page 647 of Joel Frados' "Plastics Engineering Handbook," fourth edition (Van Nostrand Reinhold Company, New York, 1976).

In one preferred embodiment, valve body 11 consists essentially of polypropylene which has a specific gravity of less than 1.0.

Figure 2:
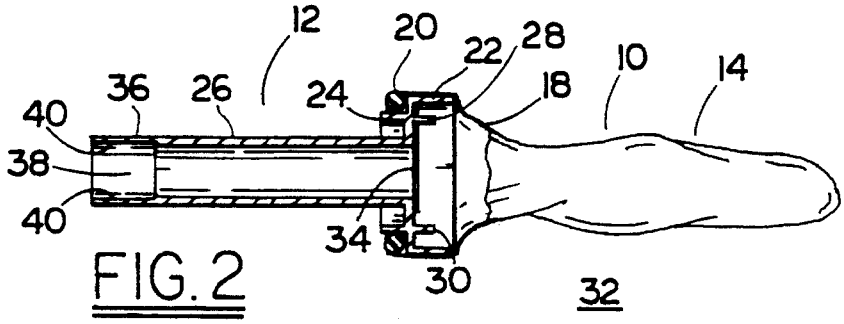
FIG. 2 is a sectional view of the assembly of FIG. 1, illustrating the balloon mounted on the valve.

FIG. 2 is a sectional view of the valve body 11 of FIG. 1 with balloon 14 mounted over flange 22 with the balloon neck 18 in contact with substantially non-circular outer surface 23 of flange 22 and the balloon bead 20 in contact with outer surface of side wall 25 of skirt 24. Referring to FIG. 2, it will be seen that flap mounting posts 28 and 30 are integrally formed with valve body 11 and are disposed within the recess 32 formed by flange 22.

The structure of applicants' valve body 11 provides an especially good static fit with balloon 14. Referring again to FIG. 2, it will be seen that, once the bead 20 of the balloon 14 has been pulled up over flange 22, the balloon bead 20 contacts the outer surface 25 of skirt 24 to provide one sealing surface, and the neck portion 18 of balloon 14 (see FIG. 1) forms yet another seal with the outer surface 23 of flange 22.

Referring again to FIG. 2, it will be seen that valve flap 34 is attached to flap mounting post 28. As will be apparent to those skilled in the art, although two flap mounting posts 28 and 30 are illustrated in the preferred embodiment of FIG. 2, only one such flap mounting post is essential. The use of two such flap mounting posts, however, allows one to mount flap 34 with valve body 11 turned in either of two directions.

In the preferred embodiment illustrated in FIG. 2, the stem 26 is comprised of a proximal end 36 comprised of a passageway or bore 38 defined by a inwardly tapered interior wall 40. As will be apparent to those skilled in the art, one may insert a tubular gas-carrying means, not shown (such as a drinking straw) into bore 38 and, by applying a moderate amount of force thereto, provide a secure interference fit between such straw and bore 38. The inwardly tapered wall 40 provides for variations in the size of nozzles of gas carrying means, including drinking straws.

It is to be preferred that bore 38 have a diameter of 0.25 inches or greater so as to not restrict the passage of large volumes of air at very low pressure (as occurs when filling the balloon by mouth).

In the embodiment illustrated in FIG. 2, no gas pressure is applied through bore 38, and the flap 34 is at rest. By comparison, in the embodiment illustrated in FIG. 3, gas under pressure (such as air forced into bore 38 in the direction of arrows 42), causes valve flap member 34 to flex and open and allows gas to pass into balloon 14.

Figure 3:
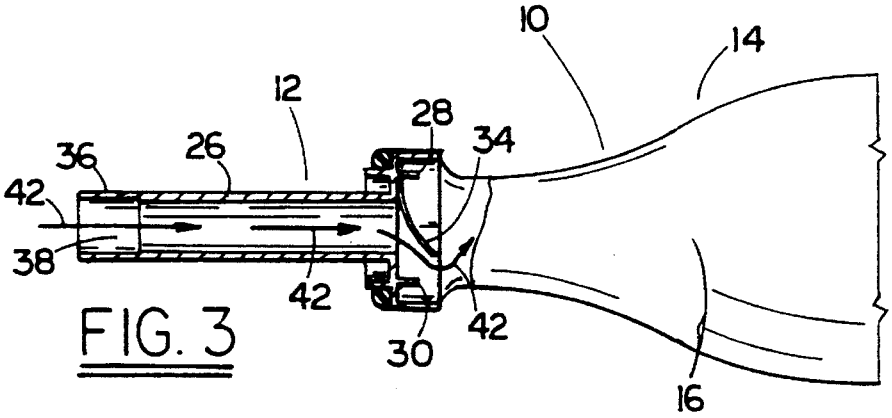
FIG. 3 is a side view of the assembly of FIG. 2, illustrating such assembly during the inflation phase.
Figure 4:
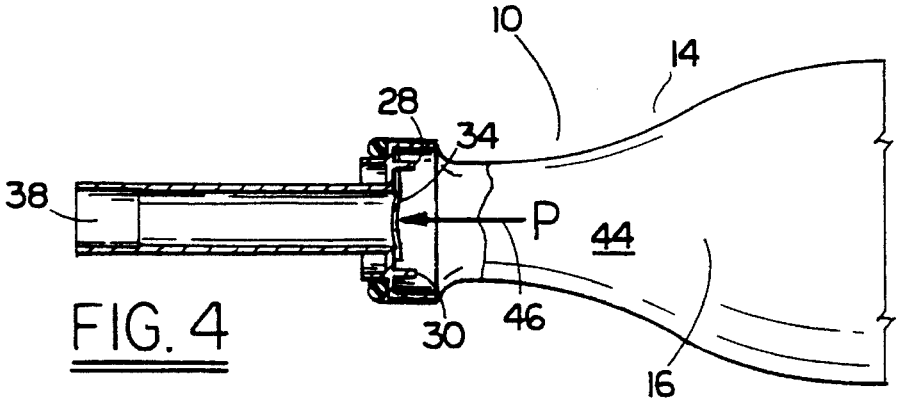
FIG. 4 is a side view of the assembly of FIG. 2, illustrating such assembly when the inflation pressure has been removed.

FIG. 4 is a sectional view of balloon valve assembly 10 after gas pressure has ceased being applied in the direction of arrows 42 (see FIG. 3). Referring to FIG. 4, it will be seen that, in this state, because the pressure of the gas within balloon 14 exceeds the pressure of the gas in bore 38, the net pressure (represented by pressure differential P) is applied in the direction of arrow 46 and causes flap 34 to seal shut. Thus, as will be apparent, applicants' preferred balloon assembly is self-sealing: once one ceases to stop filling the device, it will automatically prevent the release of gas from the balloon 14. Furthermore, one may resume filling the balloon with gas at anytime by reintroducing gas in the direction of arrows 42 (see FIG. 3).

In the preferred embodiments of FIGS. 1–4, the valve body 11 preferably weighs less than about 1.1 grams. In this embodiment, stem 26 preferably has a wall thickness of less than about 0.025 inches.

Figure 5:
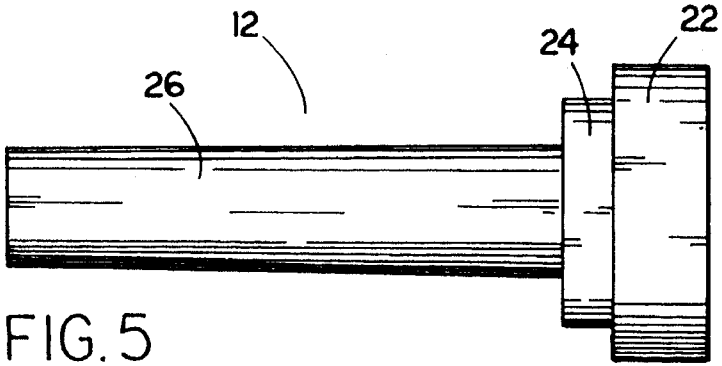
FIG. 5 is an enlarged side view of the valve of the assembly of FIG. 1.

FIG. 5 is an enlarged view of the valve body 11 of FIG. 1.

Figure 6:
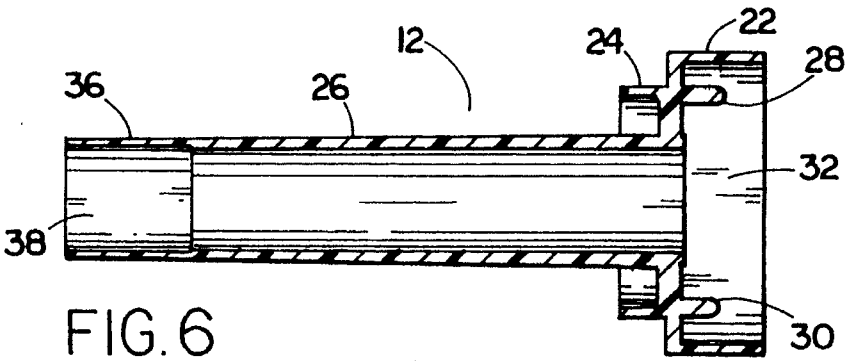
FIG. 6 is a sectional view through the major axis of the valve of FIG. 5.

FIG. 6 is an enlarged view of the valve body 11 of FIG. 2.

Figure 7:
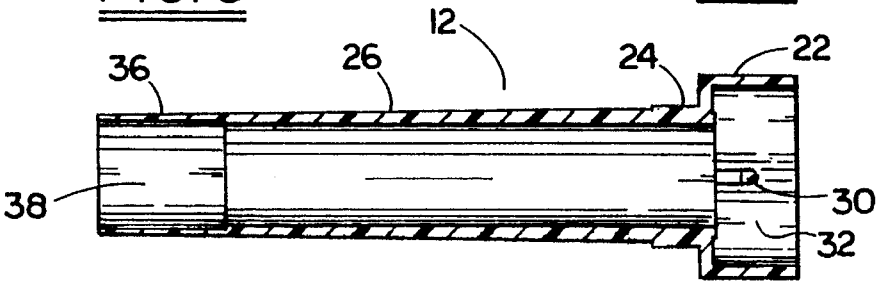
FIG. 7 is a sectional view through the minor axis of the valve of FIG. 5.

FIG. 7 is a sectional view of the valve body 11 of FIG. 6.

Figure 8:
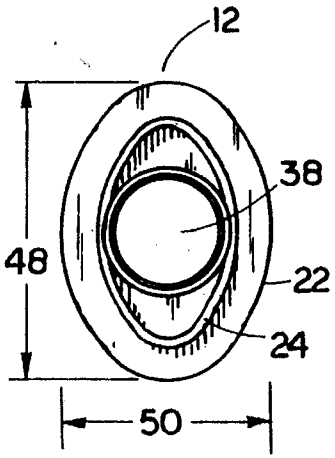
FIG. 8 is a bottom view of the valve of FIG. 5.

FIG. 8 is an end view of valve body 11, as viewed from proximal end 36 of such stem 26. Referring to FIG. 8, it will be seen that flange 22 has a continuously arcuate shape which is not circular and thus has both a maximum cross-dimension and a minimum cross-dimension which differ from each other and which define its non-circular cross-sectional shape.

Figure 9:
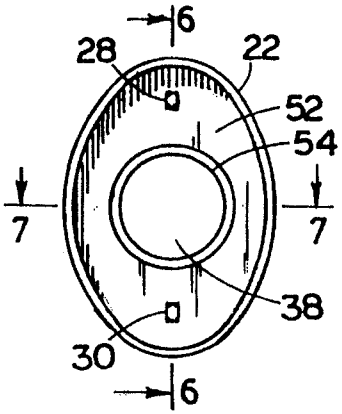
FIG. 9 is a top view of the valve of FIG. 5.

One example of such a non-circular, continuously arcuate shape is an ellipse; this embodiment is illustrated in FIGS. 8 and 9. As is known to those skilled in the art, an ellipse is the locus of all points in the plane at which the sum of the distances from a fixed pair of points, the foci, is a given constant.

Referring to FIG. 8, it will be seen that the elliptical shape illustrated therein (and all ellipses) contain both a major axis 48 and a minor axis 50. The ellipticity of the ellipse (the deviation from perfect circular form) is defined by the ratio of major axis 48 to the minor axis 50.

When flange 22 is in the shape of an ellipse, it is preferred that the ratio of major axis 48 to minor axis 50 be at least about 1.2 and, preferably, be from about 1.4 to about 1.8. In one preferred embodiment, the ratio of major axis 48 to minor axis 50 is about 1.4 to about 1.5.

In another embodiment, not shown, flange 22 is substantially oval-shaped, resembling an egg.

FIG. 9 is a top view of valve head portion 12 of valve body 11. Referring to FIG. 9, and in the preferred embodiment illustrated therein, the bottom wall 51 of valve body 11 has a surface 52 which is included within recess 32 which, in turn, is defined by side wall (flange) 22. The bottom surface 52 is preferably comprised of a valve seat 54 which is integrally formed with bottom surface 52 and extends upwardly from such bottom surface 52. This valve seat 54 preferably extends upwardly from about 0.001 to about 0.005 inches and has a shape which is substantially congruent with the shape of bore 38 and a cross-section resembling a right triangle with equal sides.

In the preferred embodiment illustrated in FIGS. 8 and 9, both bore 38 and valve seat 54 have a substantially circular shape. However, as will be apparent to those skilled in the art, bore 38 and/or valve seat 54 may have other shapes such as, e.g., an oval shape, an elliptical shape, an octagonal shape, an irregular shape, and the like. What is preferred, however, is that the minimum dimension of bore 38, regardless of its shape, be at least about 0.25 inches. In a more preferred embodiment, the minimum dimension of bore 38 is at least about 0.33 inches.

Referring again to FIG. 8, it will be seen that, in the preferred embodiment illustrated therein, skirt 24 has a shape which is substantially similar to that of flange 22.

In another embodiment, not shown, skirt 24 has a shape which is not completely arcuate.

Figure 10:
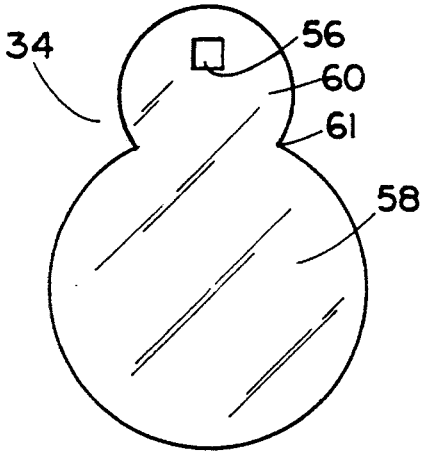
FIG. 10 is a top view of the valve flap.

FIG. 10 is a top view of a preferred valve flap 34.

Figure 11:
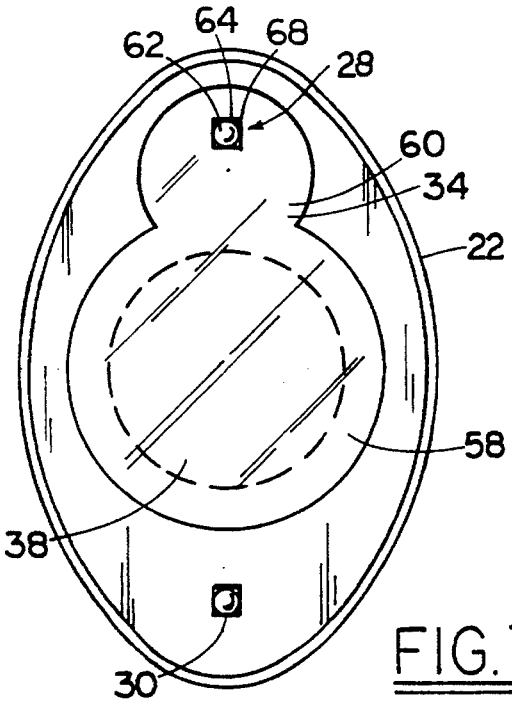
FIG. 11 is a top view of the valve of FIG. 5, showing the valve flap of FIG. 10 mounted therein.

FIG. 11 is a top view of valve flap 34 disposed within recess 32.

Referring to FIG. 10, it will be seen that valve flap 34 is preferably an integral structure which is comprised of a mounting hole 56 adapted to be force fitted over either flap mounting post 28 or flap mounting post 30 (see FIG. 11). As will be apparent to those skilled in the art, when portion 65 of post 28 is forced through polygonal hole 56 (shown as a square hole in FIGS. 10 and 11), it deforms the sides of hole 56 (see FIG. 11) and thus becomes lockably engaged therewith.

Figure 12:
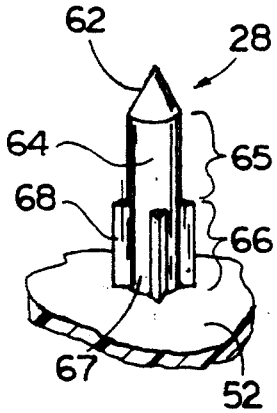
FIG. 12 is a perspective view of the valve mounting post of the valve of FIG. 5.

In the embodiment illustrated in FIGS. 10 and 11, mounting hole 56 has a polygonal shape having from about 3 to about 8 equal sides (and, in the particular embodiment illustrated, four such sides) and a maximum diagonal dimension which is larger than the top section of the mounting post 28 or 30 but is substantially the same as the bottom portion of the mounting post 28 or 30 (see FIG. 12). In one preferred embodiment, mounting hole 56 has a substantially square shape, and each of its sides is from about 0.040 to about 0.062 inches.

Referring again to FIGS. 10 and 11, it will be seen that valve flap 34 is preferably comprised of a first flap seal portion 58 and a second tab portion 60 which are preferably integrally joined to each other. In the preferred embodiment illustrated in FIG. 10, portion 58 and portion 60 are joined at point 61, which is the point at which the width of the combined structure 58 and 60 is at a minimum. This "wasp waist" configuration is believed to facilitate the flexing of the valve flap 34.

The second tab portion 60 may be of any shape which, when attached to either flap mounting post 28 or mounting post 30, will fit within recess 32 without impinging upon the interior wall of flange 22 either when flap 34 it is in its closed position (see FIG. 2) or in its open position (see FIG. 3). It is preferred that there be a distance of at least about 0.005 inches between the perimeter of flap 34 of the interior wall of the flange 22.

In the preferred embodiment illustrated in FIGS. 10 and 11, second tab portion 60 has a substantially circular shape. However, as will be apparent to those skilled in the art, other shapes may also be used for this second tab portion 60.

Similarly, the first flap portion 58, as long as it covers the bore 38 and the valve seat 54 (not shown), and as long as it does not contact the interior wall of flange 22, may also have a circular or irregular shape.

As will be apparent to those skilled in the art, in addition to not contacting the interior wall of flange 22, it is preferred that flap portion 58 also not contact the opposed mounting post.

In one preferred embodiment, flap 34 has a substantially uniform thickness of from about 0.004 to about 0.012 inches and, more preferably, from about 0.004 to about 0.008 inches. Flap 34 may consist essentially of plastic material, film material, and/or the like.

In one preferred embodiment, flap 34 is a film. As is known to those skilled in the art, a film is a flat section of a thermoplastic resin, a regenerated cellulose material, or other material that is extremely thin in comparison to its length and breadth and has a nominal maximum thickness of about 0.25 millimeters.

As is known to those skilled in the art, the protective value of a film depends on it being 100 percent continuous, i.e., without holes or cracks, since it must form an efficient barrier to molecules of gas.

In one embodiment, flap 34 consists essentially of recycled photographic film base from which the emulsion has been removed. As is known to those skilled in the art, photographic film is a thin sheet or strip of flexible cellulosic material (cellulose acetate) coated with a photosensitive emulsion. Used photographic film base may be purchased from the FPC Company of Hollywood, Calif.; this company removes the emulsion from the used film prior to its sale.

In one embodiment, flap 34 consists essentially of recycled photographic film which contains an emulsion.

In one preferred embodiment, flap 34 consists essentially of uncoated, "virgin" photographic film base which may be purchased, e.g., from said FPC Company.

In yet another embodiment, flap 34 consists essentially of polyvinyl chloride film with a thickness of about 0.009 inches. In another embodiment, flap 34 consists essentially of poly(ethylene terephthalate) film. In yet another embodiment, flap 34 consists essentially of triacetate film.

In one preferred embodiment, flap 34 is substantially transparent.

In one preferred embodiment, flap 34 is resilient, i.e., it has the ability after strain (see FIG. 3) to recover its size and form after deformation.

FIG. 12 is a perspective view of one preferred flap mounting post 30 integrally attached to surface 52; as will be apparent those skilled in the art, mounting post 28 has substantially the same structure as mounting post 30.

Referring to FIG. 12, it will be seen that flap mounting post 30 is preferably an integrally formed structure comprised of top 65, cone-shaped section 62, intermediate, cylindrically-shaped section 64, and bottom, irregularly polygonally shaped section 66.

Section 62 (the conical top) preferably has a maximum dimension which is larger than hole 56 and, thus, must be forced into such hole. Section 64, which is a continuation of section 62, thus also is larger than hole 56 and also must be forced into such hole.

Bottom section 66 is integrally formed from two separate shapes. The portion 67 of section 66 is an extension of section 64. The portion 68 of section 66 is substantially the same size and shape as hole 56 (see FIG. 10). In the preferred embodiment illustrated in FIG. 12, protrusion 68 extends outwardly from surface 67 and is adapted to keep flap 34 (see FIG. 11) from pivoting and contacting the interior wall of flange 22. Cone-shaped top portion 62 aids in centering hole 56 over flap mounting post 28 or flap mounting post 30.

In one embodiment, not shown, flap 34 is punched out of the film material described hereinabove and the punch (not shown) continues its travel through the die and pushes the flap 34 onto the post 28/30 of a suitably aligned valve body 11. The punch (not shown) has a hole therein to accept post 28/30. Mineral oil is preferably applied to the underside of flap 34, which will thereafter be put into contact with or near surface 52 (see FIG. 9). The mineral oil (or other suitable lubricant and sealant, such as, e.g., vegetable oil or animal oil), in conjunction with the valve seat 54, is adapted to cause the balloon valve assembly 10 to seal completely even when helium gas is used as the filling fluid. Without wishing to be bound to any particular theory, applicant believes that a capillary action occurs between surface 52 and the mating surface of flap 34.

Figure 13:
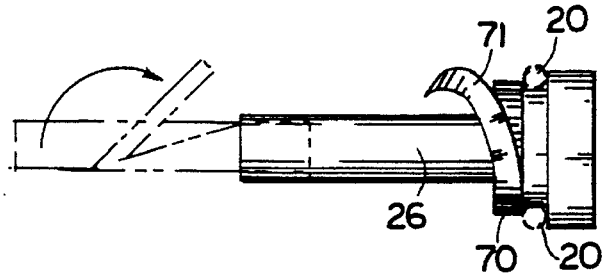
FIG. 13 is a side view of the valve/tether assembly of FIG. 15, illustrating a means of securing the tether to the valve.

FIG. 13 is a side view of one preferred embodiment of valve body 11 in which a ribbon 70 has been attached to the stem 26 of valve body 11 of assembly 10. Ribbon 70 preferably consists essentially of plastic material which may be heat joined to stem 26 of valve body 11. Thus, by way of illustration and not limitation, ribbon 70 may consist essentially of polypropylene and has a thickness of from about 0.004 to about 0.007 inches and width of from about 0.06 to about 0.3 inches. In this embodiment, and referring again to FIG. 13, ribbon 70 may be heat staked and/or sonic welded at point 72 (or at any other point on valve body 11) to valve stem 26.

It is preferred, in one embodiment, that ribbon 70 consist of substantially the same material as that of which valve body 11 is comprised of or consists of.

Figure 14:
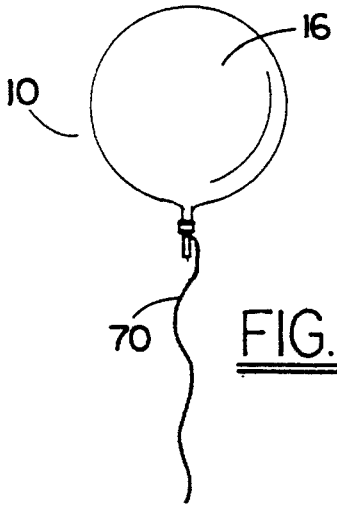
FIG. 14 is a side view of the valve assembly of FIG. 1, illustrating a ribbon tether mounted on it.

FIG. 14 is a view of the valve body 11 of FIG. 13 with ribbon 70 wound about valve stem 26. The free end 71 of ribbon 70 may be removably attached to valve stem 26 by conventional means such as, e.g., wax, hot glue, heat staking, and the like.

Figure 15:
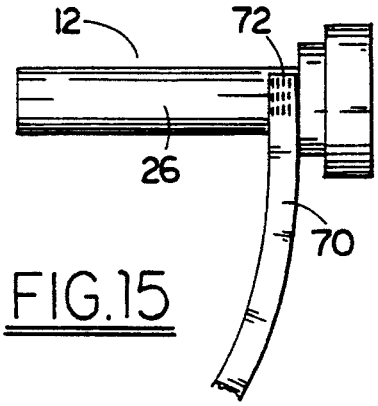
FIG. 15 is a side view of an inflated balloon, valve, and unwound tether ribbon assembly.

FIG. 15 illustrates a balloon valve assembly 10 secured with ribbon 70 which is tethered to a support surface (not shown).

Figure 16:
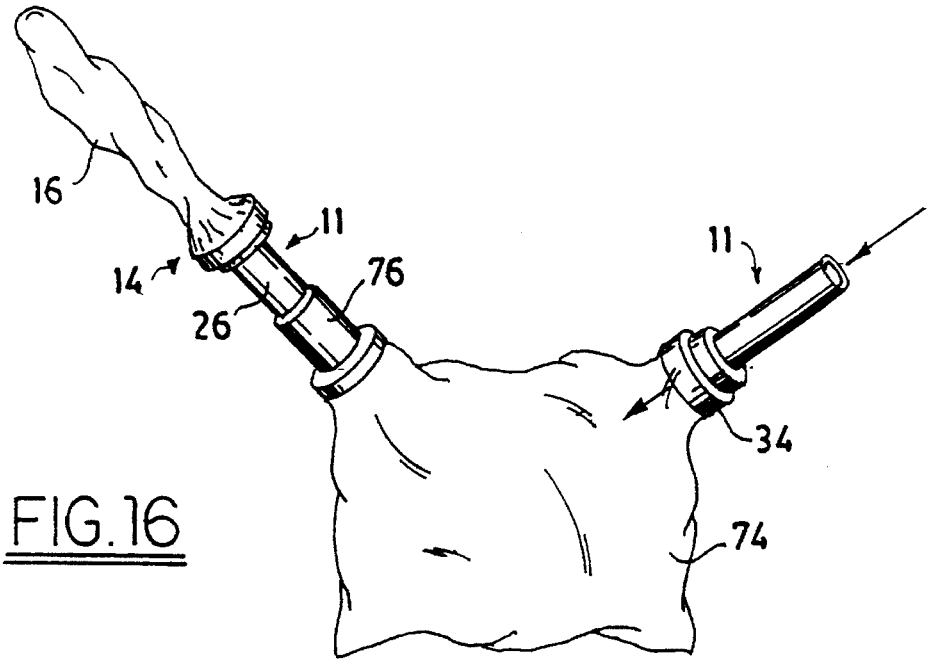
FIG. 16 is a perspective view of one preferred embodiment of a balloon pump/balloon/valve assembly.

FIG. 16 is a perspective view of one preferred embodiment of a balloon valve body 11 operably connected to a flexible, inelastic bag 74; as will be apparent to those skilled in the art, in this embodiment, the balloon valve body 11 is inserted from inside bag 74. An open, preferably tapered connector 76 is also preferably inserted from the inside of bag 74 and is operatively connected to bag 74. Stem 26 is lightly forced into connector 76. A taper on stem 26 creates a seal, and the bag is sealed on all four sides.

A more detailed teaching of how to secure inelastic bag 74 to various tubular valve assemblies is contained in applicant's U.S. Pat. No. 5,145,338, the entire disclosure of which is hereby incorporated by reference into this specification.

Figure 17:
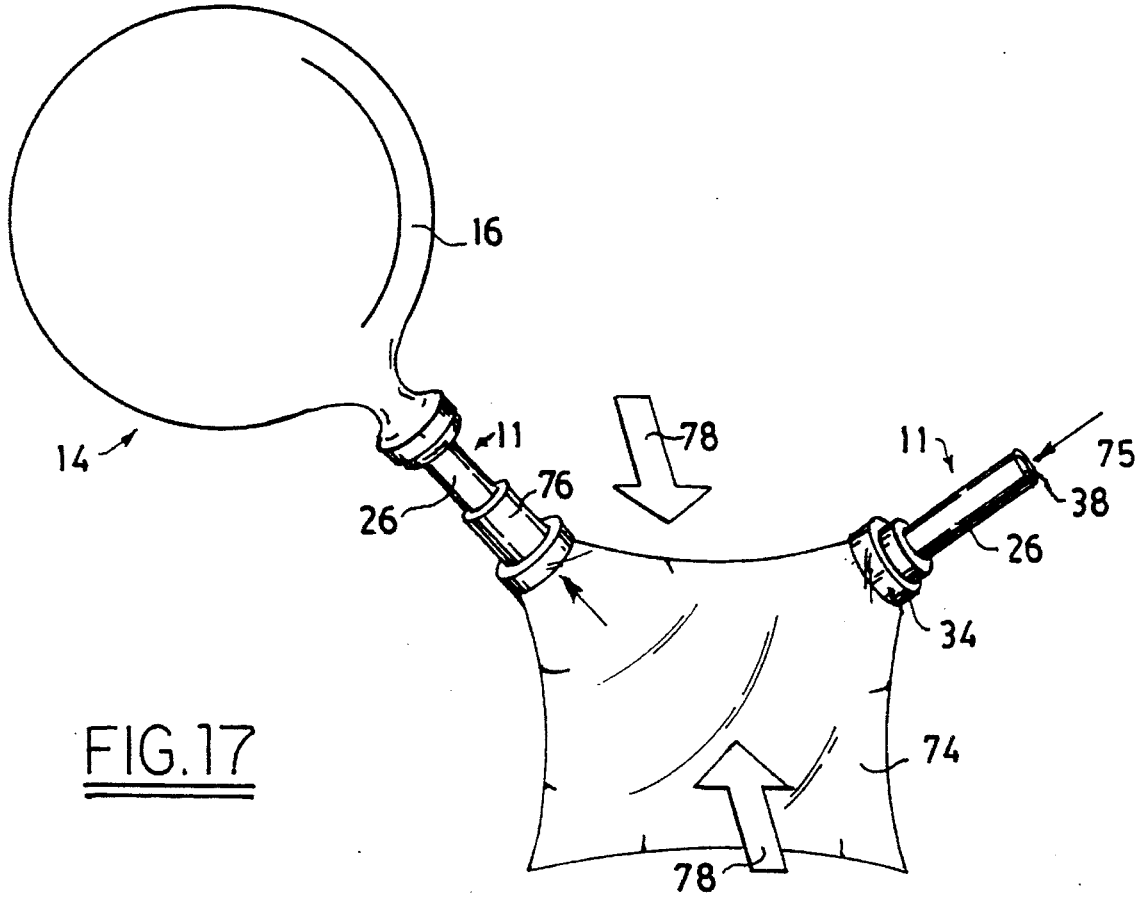
FIG. 17 is a perspective view of one preferred embodiment of a balloon pump which may be used in the apparatus of FIG. 16.

FIG. 17 shows the inelastic bag 74 after a user has lightly forced air into it in the direction of arrow 75 through bore 38 of the first balloon valve assembly 10 to fill (or partially fill) bag 74 with air. When compressive force is applied (see arrows 78), fluid is expelled from bag 74 through tapered connector 76 and the second ballon valve assembly 10 and into balloon body 14/16. As will be apparent to those skilled in the art, valve flap member 34 in valve body 11 closes and does not permit the escape of gas from inelastic bag 74 in a direction opposite to arrow 75. This process may be repeated until the balloon 14/16 is filled, whereupon the second balloon assembly can be disconnected and the air/fluid within balloon body 14/16 will be retained.

One advantage of this arrangement is that, by blowing into bore 38 with a moderate amount of force after balloon 14/16 has started to be filled with air, additional air will be caused to travel through the extended inelastic bag 74 and into the balloon 14/16 without any need for the compression of the bag. Alternatively, or additionally, the air within inelastic bag 74 may be compressed at any time to facilitate its passage into balloon 14/16.

Figure 18:
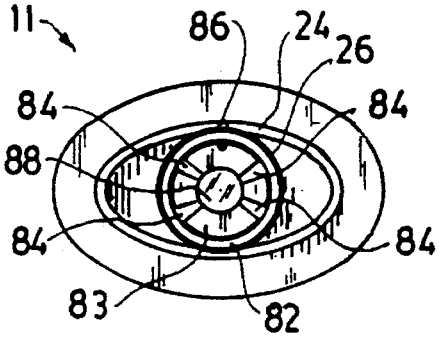
FIG. 18 is an end view of another embodiment of the balloon valve of this invention.
Figure 20:
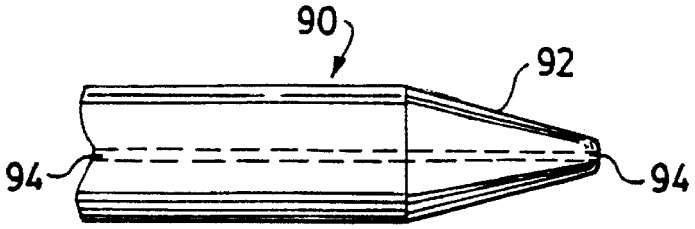
FIG. 20 is a side view of a gas filling nozzle.
Figure 21:
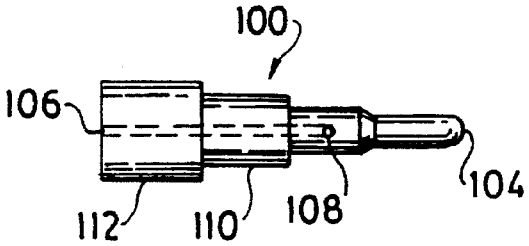
FIG. 21 is a side view of another gas filling nozzle in current use.

FIG. 18 is an end view from the proximal end of valve body 11 illustrating some preferred embodiments which enable valve body 11 to couple with a typical first gas filling nozzle (such as the one shown in FIG. 20) and a second gas filling nozzle (such as the ones shown in FIG. 21). FIG. 5 of the previously cited Cotey patent contains an example of the first filling nozzle, and the Zeyra patent (see FIG. 3) illustrates in detail a typical second gas filling nozzle. A third nozzle which may also be used is produced by the Windy Company and is very similar to the Zeyra nozzle. The Windy nozzle has the added feature of the tip portion 10B (see FIG. 3 of the Zeyra patent) telescoping into the body portion 10A at shoulder 10D to cause the gas to flow.

Figure 19:
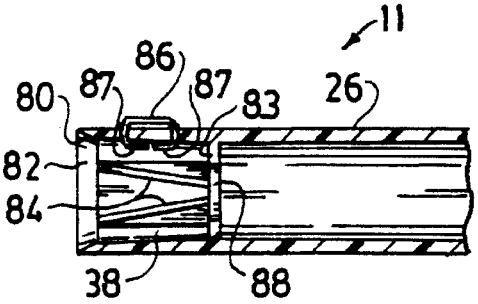
FIG. 19 is a sectional view through the minor axis of FIG. 18.

Referring to FIGS. 18 and 19, it will be seen that stem 26 terminates in a tapered portion 80 forming surface 82. The tapered portion 80 approximates the sloped angle of surface 92 of the first gas filling nozzle 90 as shown in FIG. 20. When stem 26 is placed over said first gas filling nozzle 90, a sealing relationship occurs between surface 80 and surface 92 so that gas may be caused (by means not shown) to flow through duct 94 and into bore 38 of valve body 11 and then into balloon 14/16 (not shown) as previously described.

Referring to FIG. 19, it will be seen that an inwardly projecting flange 83 integral with stem 26 forms a reduced bore portion 88, thereby creating a substantially circular hole sized to cause a moderate to light interference and a sealing fit with surface 102 of said second gas filling nozzle 100. When stem 26 of valve body 11 is mounted on the second nozzle 100 (see FIG. 21) and seated so that radial port 108 extends beyond internal flange 83, gas may be caused to flow (by means not shown) through conduit 106 of said second filling nozzle 100 and into applicant's valve body 11 and then into balloon 14/16.

Another preferred embodiment of a valve body is shown in FIG. 19 which illustrates a metal staple 86 used to secure a ribbon or string (not shown), and to locate both crimped staple legs 87 within bore 38 of stem 26 and thereby prevent the user from contacting potentially sharp staple legs 87.

Inwardly projecting tapered ribs 84 serve at least five purposes. In the first place, they further restrict user contact with the crimped staple legs 87. In the second place, they serve to guide the tip 104 of said second filling nozzle 100 into and through hole 88. In the third place, they guide a staple crimping anvil (not shown) into position. In the fourth place, they act as splines that engage with string or ribbon winding apparatuses (not shown) that cause the valve body 11 to rotate about its axis to cause a string/ribbon to be wound around stem 26. In the fifth place, ribs 84 impinge on step portion 110 (see FIG. 21) causing it to telescope into fixed portion 112 and, (by means not shown), dispense gas into valve body 11.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A balloon valve assembly for use in inflating balloons, the balloon valve assembly comprising:

(a) a tube portion including a passageway therethrough, a first free end, and a second free end;

(b) a head portion adapted for insertion into the neck of an inflatable balloon, said head portion being connected to said second end of said tube portion and having a bottom wall forming a flange to said second end, an orifice through said bottom wall communicating with said passageway, and a side wall extending from said bottom wall and defining a substantially non-circular outer surface of said head portion, wherein said non-circular outer surface has a cross-sectional shape defined by a major axis and a minor axis, and wherein the ratio of the length of said major axis to the length of said minor axis is at least 1.2; and (c) a valve flap member mounted to said bottom wall for sealing said orifice in said bottom wall.

2. The balloon valve assembly of claim 1 wherein said non-circular outer surface of said head portion has a continuously arcuate shape.

3. The balloon valve assembly of claim 1 wherein said outer surface of said head portion includes first and second side wall sections, said first side wall section having a cross-dimension greater than that of said second side wall section.

4. The balloon valve assembly of claim 1 wherein said side wall defines a recess about said orifice.

5. The balloon valve assembly of claim 1 wherein said orifice in said bottom wall is generally circular.

6. The balloon valve assembly of claim 1 including a first valve flap member mounting post formed integrally with said bottom wall and adjacent said orifice.

7. The balloon valve assembly of claim 1 wherein said first free end of said tube portion has a generally cylindrical outer surface and includes an inwardly tapered internal bore for fitting sealingly onto various types and sizes of nozzles of balloon gas filling apparatus.

8. The balloon valve assembly of claim 1 wherein said valve flap member consists essentially of a film material selected from the group consisting of polypropylene, polyethylene, vinyl acetate, and nylon.

9. The balloon valve assembly of claim 1 wherein said valve flap member consists of photographic film base material.

10. The balloon valve assembly of claim 1 wherein said valve flap member consists of a film material having a thickness of from about 0.004 to about 0.012 inches.

11. The balloon valve assembly of claim 1 wherein said non-circular outer surface of said head portion is elliptical.

12. The balloon valve assembly of claim 1 wherein the shape of said non-circular outer surface of said head portion has a a first maximum cross-dimension and a second minimum cross-dimension different from said first cross-dimension.

13. The balloon valve assembly of claim 1 wherein said non-circular outer surface of said head portion is substantially oval.

14. The balloon valve assembly of claim 3 wherein said second side wall section is narrower than said first side wall section and said first and second side wall sections are located so that upon insertion into the neck of a balloon said second narrower flange section is in sealing contact with the bead of the neck of said balloon, and said first side wall section is in sealing contact with said neck of said balloon.

15. The balloon valve assembly of claim 4 wherein said recess is non-circular.

16. The balloon valve assembly of claim 6 including a second valve flap member mounting post, said second valve flap member mounting post being located substantially opposite said first flap member mounting post.

17. The balloon valve assembly of claim 12 wherein said first cross-dimension is greater than said second cross-dimension, and the ratio of said first cross-dimension to said second cross-dimension is from about 1.2 to about 1.8.

18. The balloon valve assembly of claim 17 wherein said ratio is from about 1.4 to about 1.5.

19. The balloon valve assembly of claim 1 wherein at least one side of said valve flap member is coated with a substantially non-toxic lubricant.

20. The balloon valve assembly as recited in claim 1 including staple means for securing a tether to said assembly and wherein crimped staple legs are disposed within said tube portion.

21. The balloon valve assembly as recited in claim 1 including a series of axially extending tapered ribs on the interior wall of said tube portion disposed between said first free end and said second end.

22. The balloon valve assembly as recited in claim 6, wherein said first valve flap member mounting post has a cross-sectional shape which varies from its top to its bottom.

23. A balloon assembly comprised of a first balloon valve assembly as recited in claim 1 and a second balloon valve assembly as recited in claim 1, of said first and said second balloon valve assemblies being comprised of a head portion and a tube portion and is connected to an inelastic bag with an external surface, and wherein:

(a) said head portion of said first balloon valve assembly is connected to said inelastic bag, (b) said tube portion of said first balloon valve assembly is situated outside of said inelastic bag, (c) said tube portion of said second balloon valve assembly is removably connected to said inelastic bag, (d) said balloon valve assembly is further comprised of an elastic balloon which is mounted on said head portion of said second balloon valve assembly, whereby fluid introduced through said tube portion of said first valve assembly enters and distends said inelastic bag, and whereby when external pressure is applied to said external surface of said inelastic bag fluid within said inelastic bag is discharged through said second balloon valve assembly and into said elastic balloon.

* * * * *